US006869005B2

(12) United States Patent
Funk et al.

(10) Patent No.: US 6,869,005 B2
(45) Date of Patent: Mar. 22, 2005

(54) STAPLING METHOD AND APPARATUS

(75) Inventors: Helmut Funk, Remshalden (DE); Volkmar Schopper, Aichwald (DE); Horst Schempp, Ostfildern (DE)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 09/970,240

(22) Filed: Oct. 3, 2001

(65) Prior Publication Data

US 2002/0096549 A1 Jul. 25, 2002

(30) Foreign Application Priority Data

Oct. 6, 2000 (DE) ..... 100 49 471

(51) Int. Cl.[7] ..... B25C 5/04; B27F 7/21

(52) U.S. Cl. ..... 227/86; 227/91; 227/93; 227/97

(58) Field of Search ..... 227/86, 91, 93, 227/97

(56) References Cited

U.S. PATENT DOCUMENTS 3,642,187 A * 2/1972 Barland ..... 227/884
4,416,046 A 11/1983 Stokes
5,018,656 A 5/1991 Phelps
5,106,066 A * 4/1992 Shea et al. ..... 270/37
5,938,100 A * 8/1999 Bloser et al. ..... 227/107
6,119,911 A * 9/2000 Funk et al. ..... 227/88

FOREIGN PATENT DOCUMENTS

DE 36 14 320 A 10/1987
DE 197 12 876 A1 3/1997

OTHER PUBLICATIONS

European Patent Office Search Report dated Jan. 23, 2002 with attached cited references; Note: no English translation available for DE Patent # 36 14 320 A.

* cited by examiner

*Primary Examiner*—Scott A. Smith
*Assistant Examiner*—Gloria R. Weeks
(74) *Attorney, Agent, or Firm*—Laurence A. Greenberg; Werner H. Stemer; Ralph E. Locher

(57) ABSTRACT

The invention relates to a device for supplying, centering, and cutting a stapling wire in a stapling device, the subsequent formation of a staple, and stapling a stack of sheets. According to various aspects of the invention, methods and apparatus for feeding a wire to a lever assembly having a horizontally moveable cutter, moving the moveable cutter in a direction transverse to a stapling direction by actuating the lever assembly with the wire, and cutting the wire with the cutter, forming a staple from the wire, and driving the staple into sheets.

20 Claims, 4 Drawing Sheets

STAPLING METHOD AND APPARATUS

BACKGROUND

The invention relates to a device for supplying, centering, and cutting a wire in a stapling device, the subsequent formation of a staple from the wire, and stapling a stack of sheets.

Devices of the type mentioned above for supplying, centering, and cutting a stapling wire in a sheet stack stapling device by means of staple forming are known and are used in duplicating equipment.

DE 197 12 876-A1 discloses a sheet stack stapling device in which individual stapling wire sections are cut from stapling wire supplied from a stapling wire supply, positioned concentrically to a former and driver, formed into a staple, and driven into a stack of sheets and in which an adjustable stapling wire-cutting device is mounted so that it can slide, depending on the thickness of the stack of sheets to be stapled. A swivel-mounted control lever, which is in contact with a cam unit, engages with the cutting device. The cam unit is driven by way of a free wheel clutch, one end of which is connected to the cam unit and can be driven by a stepper motor of a stapling wire supply unit. The other end of the free wheel clutch is in engagement with a transport wheel for the stapling wire transport. The cam unit has cam sections that are assigned to different sheet stack thicknesses.

Depending on the measured sheet stack thickness, the stepper motor turns the cam unit to a setting that brings the cutting device into a position by way of the control lever, in which the wire section length can be cut as assigned to the sheet stack thickness.

In this disclosed sheet stack stapling device, the disadvantage is that the supply of the stapling wire by the length section determined for the sheet stack thickness and the centering of the stapling wire section have to be additionally carried out using control sections of control cams driven by the stepper motor that can be engaged by means of the clutch with the use of an additional stapling wire return lock, and that the positioning of the cutting device also has to be carried out by control cams controlled by the stepper motor, which is complicated in design and costly and critical for functional safety and positioning accuracy. In addition, in the case of a malfunction after the stapling wire has been supplied, in which the length of the stapling wire has to be determined again because of a subsequently modified sheet stack height, the supplied stapling wire can only be transported back by lifting the return lock and by operating the stepper motor in the opposite rotation direction.

DE 197 12 876-A1 is hereby incorporated by reference as if fully set forth herein.

SUMMARY

According to various aspects of the invention, methods and apparatus for feeding a wire to a lever assembly having a cutter, moving the cutter in a direction transverse to a stapling direction by actuating said lever assembly with the wire, and cutting said wire with the cutter, forming a staple from the wire, and driving the staple into sheets.

DETAILED DESCRIPTION

Various aspects of the invention are presented in FIGS. 1–4, which are not drawn to scale, and wherein like parts in the numerous views are numbered alike. In this process, the apparatus and methods of the invention may be implemented in various types of printing machines and finishing equipment, and is particularly well suited for use in a copy machine although the invention is not so limited.

The device according to the invention is part of a conventional stapling device, which is partially not shown or described in further detail, for supplying stapling wire W from a conventional stapling wire supply that is not shown and cutting a stapling wire length section WS, as well as for forming and driving in staples in a stack of sheets ST.

Figure 1:
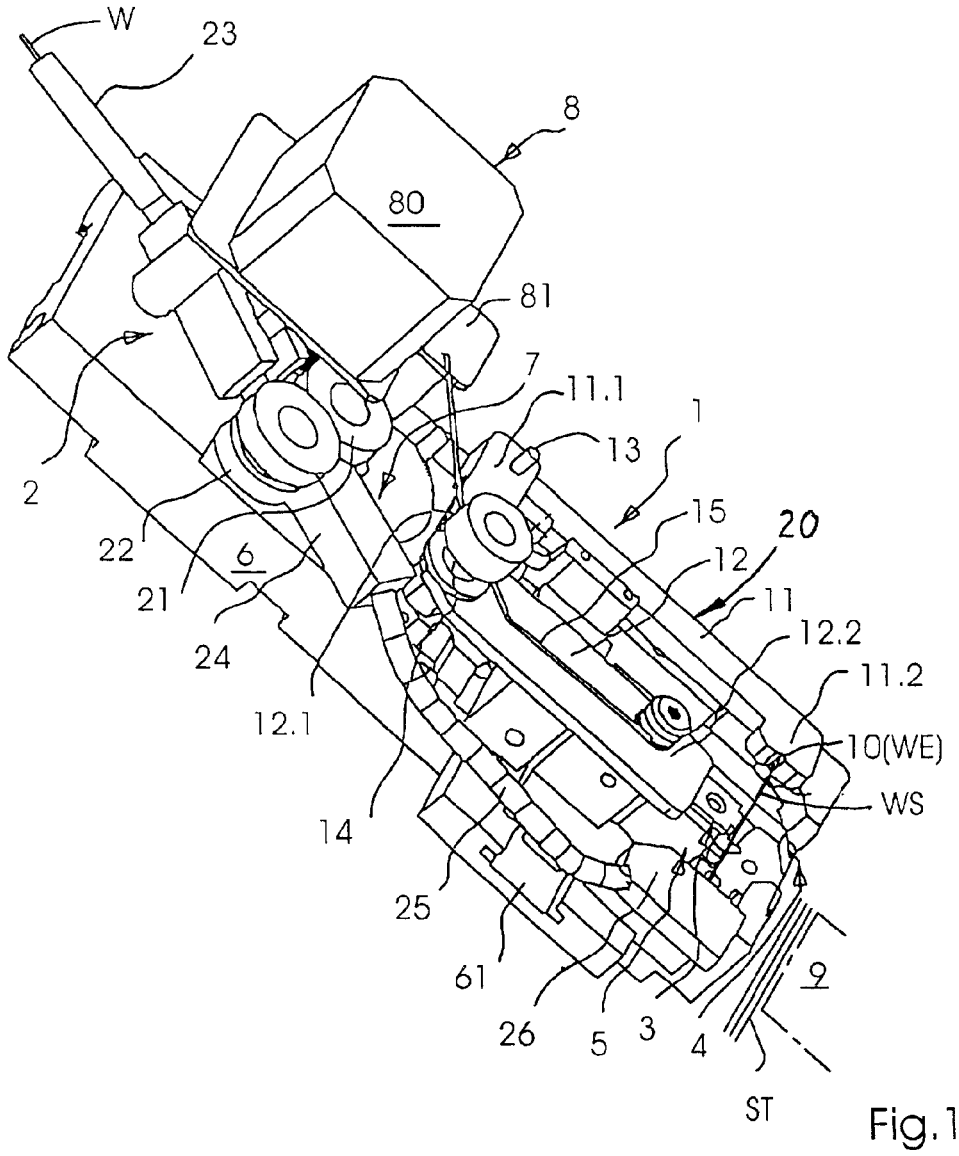
FIG. 1 presents a device according to one aspect of the invention in a partially shown sheet stack stapling device with stapling wire supply unit, wire-cutting unit, and staple-forming elements in a three-dimensional representation.
Figure 2:
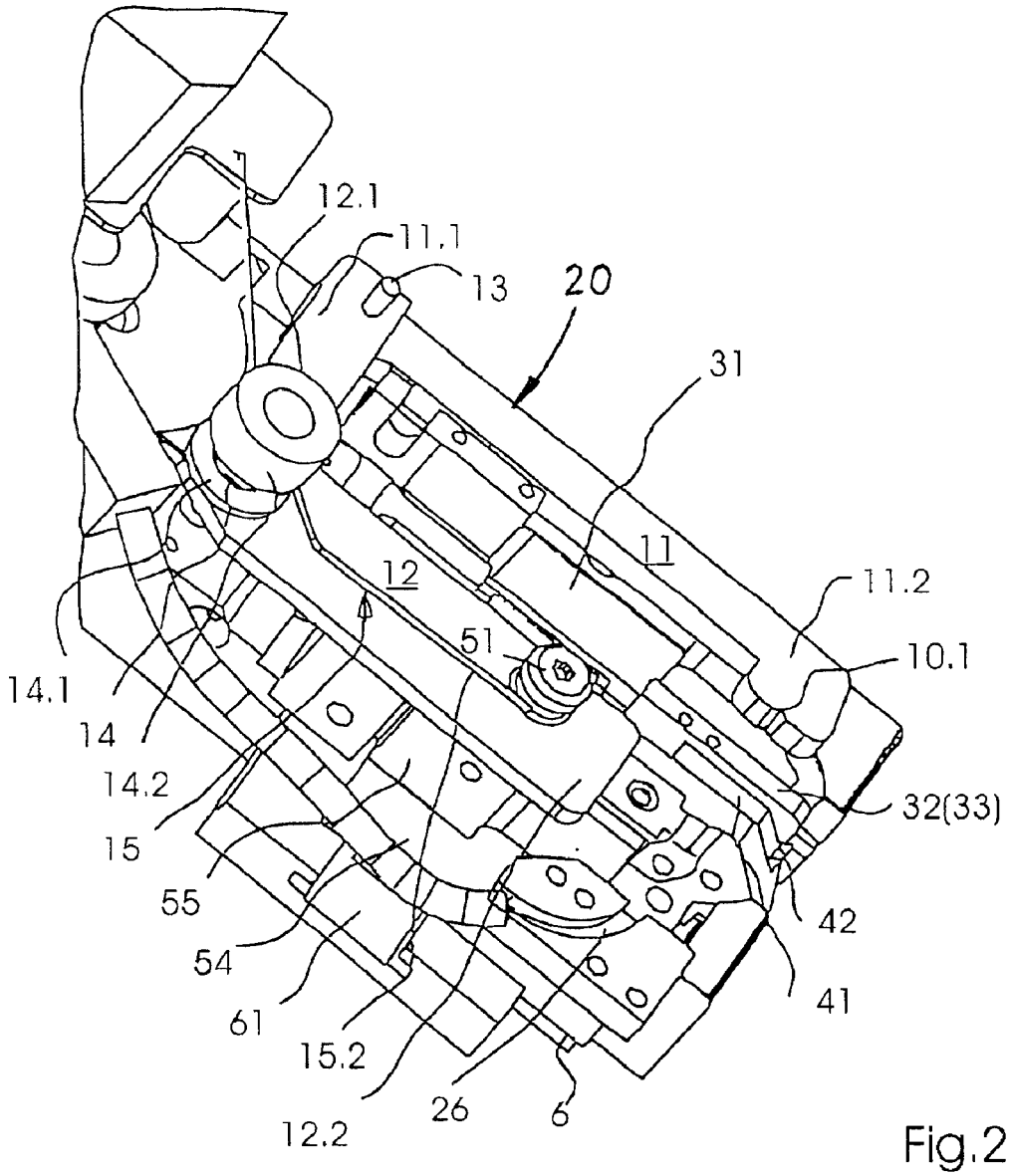
FIG. 2 presents the device of FIG. 1 in an enlarged, partially open partial view.
Figure 3:
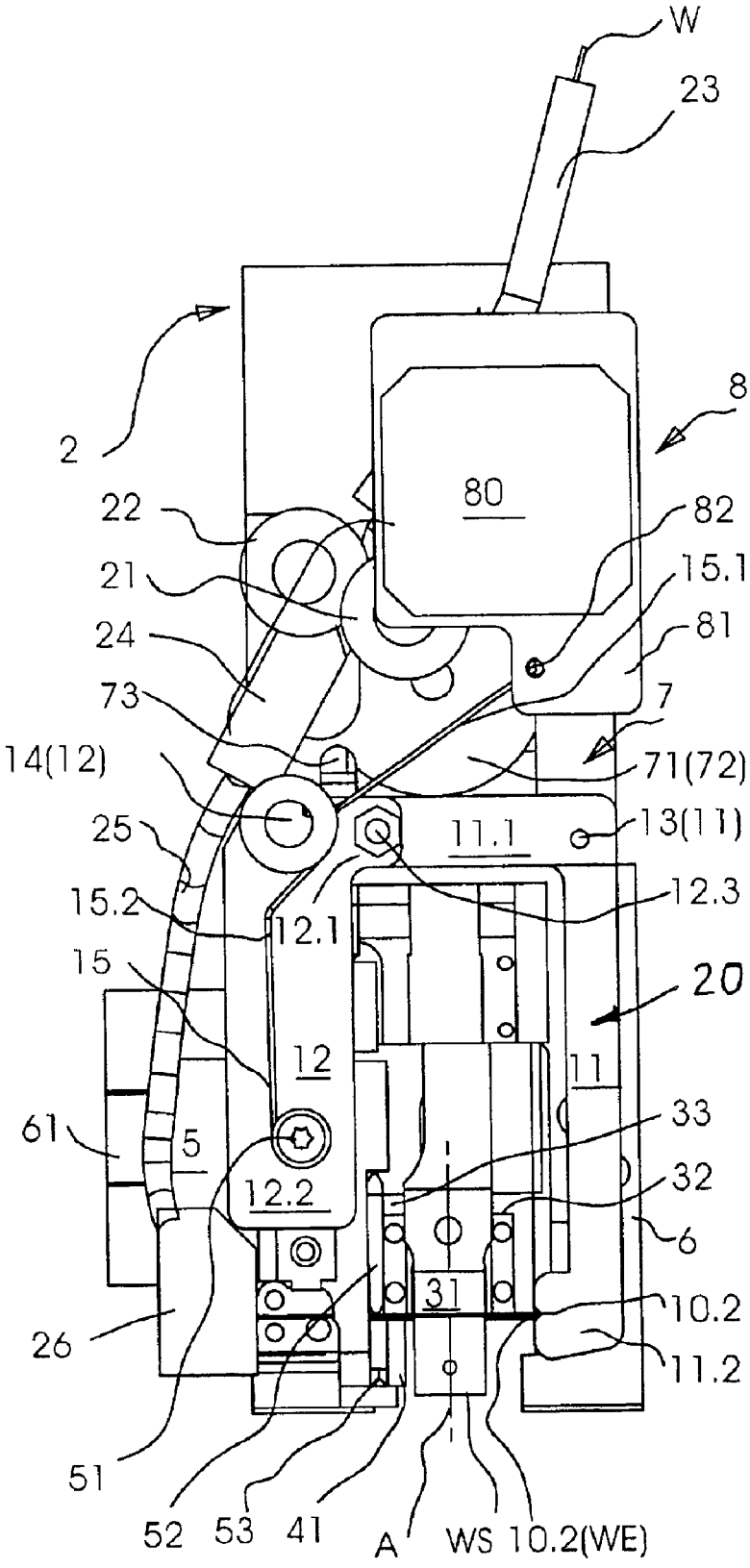
FIG. 3 presents the device of FIG. 1 in a front view.

Referring now to FIGS. 1 through 3 a stapling apparatus 1 having a stapling head is presented, according to one aspect of the invention comprising a supply unit 2 for stapling wire W, a wire cutter 5, a clamping unit 4 for the stapling wire length section WS and staple-forming elements 3 for the cut stapling wire length section and also has a conventional, schematically illustrated anvil unit 9 with a contact surface for the sheet stack ST to be stapled, whereby the anvil unit 9 has a conventional bending unit that is not shown for the ends of the staple driven through the sheet stack.

The stapling wire supply unit 2 has, on stapler body 6 of the stapling apparatus 1, a pressure roller 22 and a transport roller 21 driven by a microprocessor-controlled drive unit 8 for stapling wire transport, as well as an intake tube 23 for guiding the stapling wire W and an introduction funnel 24, a guide tube 25, and a wire straightening sleeve 26 after the rollers 21, 22. The supply of the stapling wire W by means of the supply unit is carried out in this process in length sections WS, the length of which is determined by a predetermined stack thickness of the sheet stack ST to be stapled and by a signal from sensor 10 for recording one guide end WE of the supplied stapling wire, whereby stapling wire W is supplied into a position at the staple-forming elements 3 of the stapling device, in which the stapling wire length section WS that is stopped by clamping unit 4 and cut by wire-cutting unit 5 is positioned concentrically to the center of the staple-forming elements 3.

In this process, stapling wire supply unit 2 can be driven by means of a microprocessor-controlled stepper motor 80 of drive unit 8, whereby in each case the required length of stapling wire length section WS can be determined by a specified number of steps made by stepper motor 80, starting from recording of the stapling wire guide end WE by sensor 10.

As is shown, especially in FIGS. 1 and 3, the conventional clamping unit 4 and staple-forming elements 3 are mounted concentrically to the vertical center axis and/or symmetrical axis A in a stapling direction of the stapling apparatus 1 and transverse to the stapling direction, at a right angle for example, concentrically to the stapling wire length section WS guided through the straightening sleeve 26 on stapler body 6 and at its upper end can be actuated by means of drive unit 8 of stapling wire supply unit 2, the first and second cam 71, 72 of cam unit 7 also mounted on stapler body 6 can be operated in a conventional manner for clamping the stapling wire length section WS, for forming the staple and for driving it into the sheet stack ST.

Figure 4:
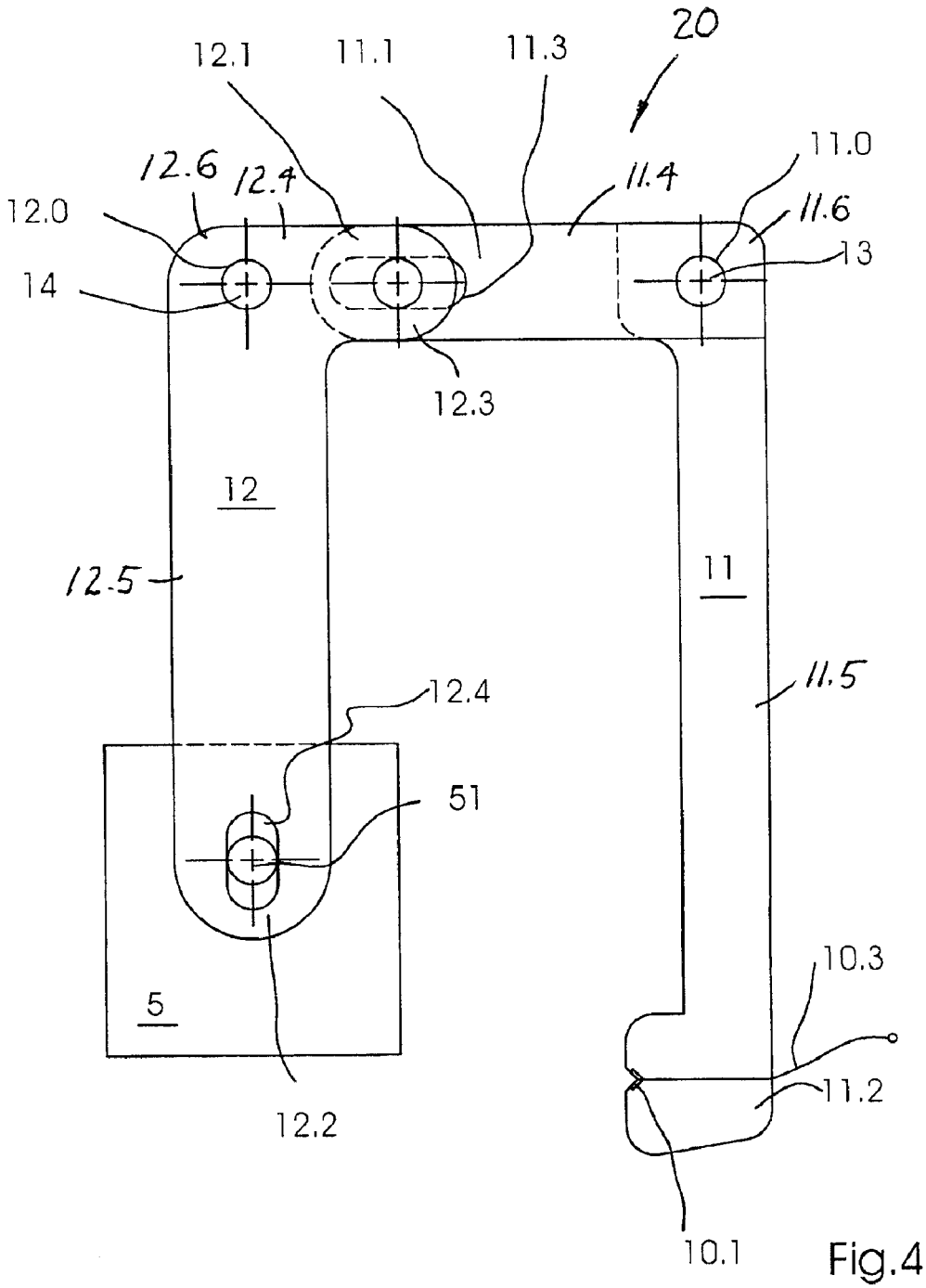
FIG. 4 presents an enlarged view of a lever apparatus implemented in the device of FIG. 1.

The stapling apparatus 1 has, as shown especially in FIGS. 3 and 4, a lever assembly 20 comprising two levers 11, 12 in the area at the side of the staple-forming elements 3 for centering the stapling wire length section WS, these levers being loosely connected to each other in active connection with their first free ends 11.1, 12.1 and each can be swiveled, in counter-rotation, synchronously and by the same amount symmetrically to the staple-forming elements on pivots 13, 14 mounted on the stapler body 6 by supplying the stapling wire W and when its guide end WE impacts into the second free end 11.2 of the first lever 11. In a certain embodiment, the lever assembly 20 positions the cutter 5 at a first position corresponding to a minimum staple length, and moves the cutter 5 in a direction transverse to a stapling direction to a second position corresponding to a longer staple length. The cutter 5 may be moved from the first position to the second position by driving the wire W, and more particularly, the wire end WE, against a portion of said lever assembly 20 a predetermined distance.

The cutter 5, which is essentially designed in the conventional manner, is mounted on the second free end 12.2 of the second lever 12 of stapling apparatus 1 in such a way that for cutting the stapling wire length section WS depending on the sheet stack thickness, the wire-cutting unit 5 can be moved back and forth by means of second lever 12 along length section WS of stapling wire W.

The two levers 11,12 are designed so that they are essentially L-shaped, and their corresponding pivots 13,14 are each mounted proximate an intersection of their L-sides. Each pivot 13,14 comprises a bearing pin 13,14 mounted on stapler body 6 of the stapling apparatus 1 on which a corresponding lever 11,12 can be mounted so that it swivels by means of its bearing hole 11.0, 12.0.

The lever assembly 20 comprises two levers 11 and 12. Each of the levers 11,12 has a first side 11.4,12.4, respectively, extending in a first direction transverse to the stapling direction (horizontal in FIG. 4), and a second side 11.5,12.5, respectively, extending in a second direction corresponding to the stapling direction (vertical in FIG. 4). The first sides 11.4,12.4, and corresponding ones of the second sides 11.5,12.5, form an intersection 11.6,12.6. Each of the levers is mounted to the stapler body 6 by a pivot 13 and 14 proximate the intersection 11.6,12.6. The first sides 11.4,12.4 are cooperatively connected together such that movement of one of the levers 11,12 about its pivot 13 or 14 causes the other of the levers 12,11 to rotate about its pivot 14 or 13. According to the embodiment presented, the levers 11,12 have on their first free ends 11.1,12.1 coupling elements 11.3,12.3, by means of which the levers are connected with each other in an active connection. In this process, the coupling elements have on one of the first sides 11.4,12.4 a slot 11.3 elongate in the first direction transverse to the stapling direction, and a cylindrical guide pin 12.3 is received within the slot 11.3 mounted to another of the first sides 12.4,11.4. In such manner, the levers 11, 12 are configured to rotate about a common pivot 12.3 that translates relative to the stapler body 6 upon actuation of the lever assembly 20.

The second sides 11.5,12.5 are extend in a second direction corresponding to the stapling direction and may run essentially parallel to each other. Each lever 11,12 comprises second free ends 11.2,12.2.

According to a further aspect of the invention, one of the levers 12 has shorter legs 12.4,12.5 than corresponding legs 11.4,11.5 of another of the levers 11. In the embodiment presented, the second lever 12 has first and second side lengths that are shorter in comparison to the first lever 11 in order to be able to guide the guide end WE of stapling wire W from the straightening sleeve coming from the second end 12.2 of second lever 12 to the second end 11.2 of first lever 11 and also to compensate a shorter swivel distance or swivel amount due to the shorter length of the second end 12.2 of second lever 12.

According to a further aspect of the invention, and as will be described more fully, the wire W is driven toward a sensor positioned on a first portion of 20 lever assembly until the wire W contacts the sensor with the cutter at the first position corresponding to a minimum staple length, and thereafter the wire W is driven a predetermined distance against the portion of the lever assembly thereby moving the cutter 5 to the second position corresponding to the longer staple length. As will be seen, the cutter 5 may be positioned opposite the sensor.

The second end 11.2 of the first lever 11 is provided with a wire sensor 10, that may comprise a first electrical contact of the sensor 10 for recording the stapling wire guide end WE. A second electrical contact may be formed by the supplied guide end WE of stapling wire W, whereby the stapling wire W can be connected or is connected by way of the wire straightening sleeve 26 to a ground connection on a power supply unit, thereby forming a switch that senses the presence of the wire end WE at the first electrical contact. According to a further aspect of the invention, the wire W is driven toward the sensor positioned on a first portion of lever assembly 20 until the wire W contacts the sensor with the cutter at the first position corresponding to a minimum staple length, and thereafter the wire W is driven a predetermined distance against the portion of the lever assembly thereby moving the cutter 5 to the second position corresponding to the longer staple length.

One of the legs 11.5 may be provided with an essentially conical recess 10.1 in the area of the second end 11.2 of the first lever 11 for guiding and holding the supplied stapling wire guide end WE. The sensor 10 may be located within the conical recess 10.1, and may be configured as an electrical contact point at the bottom of the conical recess 10.1 in order to make definite and/or precise contact with the wire end WE. The second end 11.2 of first lever 11 may be comprised of a material that is not electrically conductive, except for the electrical contact within the conical recess 10.1. As a connection to a conventional control unit that is not shown, an electrical signal wire 10.3 is provided.

The cutter 5 is mounted with its guide part 54 in a linear guide rail 61 of a known type mounted on stapler body 6 of the sheet stack stapling device so that it can be slid transverse to the stapling direction, for example horizontally and at a right angle to symmetrical axis A of the stapling device. A cylinder pin 51 may be mounted to the cutter 5 and received within a slot 12.4 elongate in the stapling direction on the second end area 12.2 of the second lever 12, thereby providing a connection loose in the stapling direction with second lever 12 and thus is in active connection with it (see FIG. 4).

The cutter 5, after it is slid into the position predetermined by the stack of sheets, caused by supply of the stapling wire by the required length section WS, can be moved vertically by means of the cams 71, 72, can be stopped by conventional tappets 73 of the stapling device and its upper cutting knife 52 mounted on holding block 55 of wire-cutting unit 5 can be moved vertically by means of the tappet 73 in a conventional manner against a lower fixed cutting knife 53 of the holding block.

The lever assembly 20 may be biased to a rest position, for example by a spring element 15, as shown in FIGS. 1 to 3. The spring 15 may be mounted so that it can swivel on bearing pin 14 of second lever 12; whereby its first spring leg 15.1 is stopped on a stapler body part 81 of the stapling device and/or the drive unit 8 and its second spring leg 15.2 engages on the second lever 12 in the area of its second end 12.2 on cylinder pin 51 of the wire-cutting unit, in such a way that because of the spring force of spring 15 both levers 11, 12 can be held with their second free ends 11.2, 12.2 opposite each other transverse to the stapling direction at an initial position and/or can be brought into the initial position. According to FIG. 2, for the purpose of being able to be swiveled freely and for guiding purposes, the spring 15 is arranged with its bearing eye mounted between the first and second spring leg on bearing pin 14 between a lower guide flange 14.1 lying on the second lever 12 and an upper guide flange 14.2 fixed on the upper end of bearing pin 14.

The device operates as follows, according to a further aspect of the invention. First the stapling wire W is transported by means of the transport roller 21 and pressure roller 22 of supply unit 2 driven by the program-controlled stepper motor 80 with its guide end WE through wire straightening sleeve 26 to the electrical contact.

After the thickness of the stack of sheets is determined in a conventional manner and sheet stack ST is guided between the stapling head and the anvil unit 9 of the sheet stack stapling device and is placed on a contact surface of anvil unit 9, the stapling wire WS is transported by means of supply unit 2 and the microprocessor-controlled stepper motor 80 until guide end WE of the stapling wire makes electrical contact with switching contact 10.1 of sensor 10 on the second end 11.2 of the first lever 11 that is in initial position and/or beginning position of device 1 according to the invention.

If sheet stack ST has a thickness and/or height for which one staple with the shortest stapling wire length section WS is adequate, the stapling wire supply will be stopped by uncoupling the transport roller 21 from stepper motor 80 and blocking transport roller 21, whereby this is carried out using a conventional coupling unit that is not shown.

At the same time, cam unit 7 is coupled by means of the coupling unit and thus by operating the stapling unit 4, the wire-cutting unit 5, and the staple-forming/driving elements 3 by means of cam disks 71, 72 and tappet 73, stapling and cutting of the stapling wire length section WS is carried out in the conventional manner and the staple is formed and driven with its two pointed end sections through the stack of sheets and bent by the bending grooves of the anvil unit 9.

However, if sheet stack ST has a thickness that is greater, for which a larger stapling wire length section is necessary for forming a staple with longer end sections, stapling wire W will be transported and/or supplied by means of supply unit 2 by the number of steps of microprocessor-controlled stepper motor 80 required, until the necessary length is reached.

While additional stapling wire W is supplied by supply unit 2, the two levers 11 and 12 of device 1 will be swiveled, with their two ends 11.2 and 12.2 symmetrically away from symmetrical axis A of the stapling device from their starting/initial position, against the spring force of pressure spring 15 by means of guide end WE of the stapling wire and in this process, wire-cutting unit 5 will be slid opposite the stapling wire supply device by the same amount that the stapling wire supply is slid away from symmetrical axis A.

After the staple has been driven into sheet stack ST and clamped, the stapling unit 5 will be brought back into initial position with its lower/upper clamping jaws 41, 42, the staple-forming/driving elements with its first/second forming jaws 32, 33 and driver 31, and also the two levers 11, 12 and the wire-cutting device 5 will be brought back into initial position by means of cam unit 7 and drive unit 8. During this process, the return of levers 11, 12 and wire-cutting unit 5 occurs, guided by the cam disks 71, 72 by means of the spring force action of pressure spring 15.

Subsequent to the return of the named functional units to their initial positions, cam unit 7 is decoupled from drive unit 8, stapling wire supply unit 2 is coupled again to the stapling wire guide and the functional sequence described above can be started again if necessary.

In the case of an erroneous or malfunctioning stapling wire supply, if there is a stapling wire length section WS of stapling wire W that is too short or too long, the stapling wire W will return by means of supply unit 2 and stepper motor 80 of drive unit 8 until release of contact point 10.1 of sensor 10 and then be transported forward again until contact with contact point 10.1, whereby a further forward transport of the stapling wire, as described above, is determined by the thickness and/or height of sheet stack ST.

In a certain embodiment, two levers are mounted, according to one aspect of the invention, in the area of the staple-forming elements, for centering the stapling wire length section, which with their first free ends are loosely linked to each other in an active connection and each of which can be swiveled around an assigned bearing location against a spring force of a spring element by the supply of the stapling wire and the impact of its guide end on the second free end of the first lever, synchronously and by the same amount symmetrically to the staple-forming elements; and that at the second free end of the second lever the wire-cutting unit is mounted in such a way that it can move back and forth along the guide end of the stapling wire by means of the second lever.

In an advantageous manner, the two levers are designed essentially in an L shape, with a bearing point arranged in the area of the point of intersection of their L-sides; the first L-sides of the levers pointing toward each other are first free ends of the levers with coupling elements, by means of which the levers are in active connection with each other and the second, essentially parallel L-sides are the second free ends of the levers.

In addition, the second lever has shorter first and second side lengths compared to the first lever, in order to be able to guide the guide end of the stapling wire past the second end of the second lever to the second end of the first lever and also to compensate for the shorter swivel distance of the second end of the second lever caused by the reduced length of the shorter second shank.

In addition, in an advantageous manner, the second end of the second lever is designed as a first electrical switching contact of the sensor for recording the stapling wire guide end, the second electrical switching contact of which is formed by means of the supplied guide end of the stapling wire and advantageously the stapling wire supply unit can be driven by means of a microprocessor-controlled stepper motor of a drive unit, whereby in each case the required length of the stapling wire length section can be determined by a predetermined number of steps of the stepper motor, starting from recording of the stapling wire guide end by the sensor.

What is claimed is:

1. A method for stapling sheets, comprising:

feeding a wire to a lever assembly having a cutter;

moving said cutter in a direction transverse to a stapling direction by mechanically driving said lever assembly with said wire; and, cutting said wire with said cutter, forming a staple from said wire, and driving said staple into said sheets.

2. The method of claim 1, further comprising biasing said lever assembly to a rest position.

3. The method of claim 1, wherein said lever assembly positions said cutter at a first position corresponding to a minimum staple length, and further comprising moving said cutter in said direction transverse to said stapling direction to a second position corresponding to a longer staple length.

4. A method for stapling sheets, comprising:

feeding a wire to a lever assembly having a cutter;

moving said cutter in a direction transverse to a stapling direction by mechanically driving said lever assembly with said wire; and, cutting said wire with said cutter, forming a staple from said wire, and driving said staple into said sheets;

wherein said lever assembly positions said cutter at a first position corresponding to a minimum staple length, and further comprising moving said cutter in said direction transverse to said stapling direction to a second position corresponding to a longer staple length by driving said wire against a portion of said lever assembly a predetermined distance.

5. A method for stapling sheets, comprising:

feeding a wire to a lever assembly having a cutter;

moving said cutter in a direction transverse to a stapling direction by actuating said lever assembly with said wire; and, cutting said wire with said cutter, forming a staple from said wire, and driving said staple into said sheets;

further comprising driving said wire toward a sensor positioned on a first portion of said lever assembly until said wire contacts said sensor with said cutter at a first position corresponding to a minimum staple length, and thereafter driving said wire a predetermined distance against said portion of said lever assembly thereby moving said cutter to a second position corresponding to a longer staple length.

6. The method of claim 5, wherein said cutter is opposite said sensor.

7. A method for stapling sheets, comprising:

feeding a wire to a lever assembly having a cutter;

moving said cutter in a direction transverse to a stapling direction by mechanically driving said lever assembly with said wire; and, cutting said wire with said cutter, forming a staple from said wire, and driving said staple into said sheets;

wherein said lever assembly positions said cutter at a first position corresponding to a minimum staple length, and further comprising moving said cutter in said direction transverse to said stapling direction to a second position corresponding to a longer staple length by driving said wire a predetermined distance into a portion of said lever assembly with a stepper motor.

8. A method for stapling sheets, comprising:

feeding a wire to a lever assembly having a cutter;

moving said cutter in a direction transverse to a stapling direction by mechanically driving said lever assembly with said wire; and, cutting said wire with said cutter, forming a staple from said wire, and driving said staple into said sheets;

wherein said lever assembly comprises two levers configured to rotate about a common pivot, said cutter being connected to one of said levers, and further comprising moving said cutter in said direction transverse to said stapling direction by actuating said lever assembly with said wire.

9. A method for stapling sheets, comprising:

feeding a wire to a lever assembly having a cutter;

moving said cutter in a direction transverse to a stapling direction by mechanically driving said lever assembly with said wire;

cutting said wire with said cutter, forming a staple from said wire, and driving said staple into said sheets; and biasing said lever assembly to a rest position;

wherein said lever assembly comprises two levers configured to rotate about a common pivot, said cutter being connected to one of said levers, and further comprising moving said cutter in said direction transverse to said stapling direction by actuating said lever assembly with said wire.

10. A stapling apparatus that forms wire into staples, comprising:

a lever assembly mounted to a stapler body and configured to be mechanically driven by the wire;

a cutter connected to said lever assembly and moveable in a direction transverse to a stapling direction upon driving of said lever assembly by the wire; and staple forming and driving elements mounted to said stapler body and moveable in said stapling direction.

11. The apparatus of claim 10, further comprising an biasing element that biases said lever assembly toward a rest position.

12. The apparatus of claim 10, wherein said lever assembly positions said moveable cutter at a first position corresponding to a minimum staple length, and said lever assembly is configured to move said moveable cutter in said direction transverse to said stapling direction to a second position corresponding to a longer staple length.

13. The apparatus of claim 10, further comprising a wire supply unit driven by a stepper motor, wherein a wire length is determined by a predetermined number of steps of said stepper motor.

14. A stapling apparatus that forms wire into staples, comprising:

a lever assembly mounted to a stapler body and configured to be actuated by the wire;

a cutter connected to said lever assembly and moveable in a direction transverse to a stapling direction upon a mechanical driving of said lever assembly by the wire; and staple forming and driving elements mounted to said stapler body and moveable in said stapling direction;

wherein said lever assembly comprises two levers, each of said levers having a first side extending in a first direction transverse to said stapling direction, each of said levers having a second side forming an intersection with a corresponding said first side and extending in a second direction corresponding to said stapling direction, each of said levers being mounted to said stapler body by a pivot proximate said intersection, said first sides being cooperatively connected together such that movement of one of said levers about its pivot causes the other of said levers to rotate about its pivot.

15. The apparatus of claim 14, wherein each said pivot comprises a bearing pin, each of said pair of levers comprises a pivot hole that receives said bearing pin, wherein one said first side comprises a slot elongate in said first direction, and another said first side comprises a guide pin received within said slot.

16. The apparatus of claim 14, further wherein said cutter is mounted to said stapler body in a manner that allows movement transverse to said stapling direction, an end of a second side comprises a slot elongate in said second direction, and a pin is received within said slot mounted to said cutter.

17. A stapling apparatus that forms wire into staples, comprising:

a lever assembly mounted to a stapler body and configured to be mechanically driven by the wire;

a cutter connected to said lever assembly and moveable in a direction transverse to a stapling direction upon actuation of said lever assembly by the wire; and staple forming and driving elements mounted to said stapler body and moveable in said stapling direction;

wherein said lever assembly comprises two levers, each lever having a pair of legs, one of said levers having shorter said legs than corresponding said legs of another of said levers.

18. A stapling apparatus that forms wire into staples, comprising:

a lever assembly mounted to a stapler body and configured to be actuated by the wire;

a cutter connected to said lever assembly and moveable in a direction transverse to a stapling direction upon actuation of said lever assembly by the wire; and staple forming and driving elements mounted to said stapler body and moveable in said stapling direction;

wherein said lever assembly comprises two levers, each lever having a first side extending in a first direction transverse to said stapling direction, each lever having a second side extending in a second direction corresponding to said stapling direction, one said second side having a wire guide, and another said second side having a wire sensor opposite said wire guide.

19. The apparatus of claim 18, wherein said another said second side comprises a conical recess and said wire sensor is located within said conical recess.

20. A stapling apparatus that forms wire into staples, comprising:

a lever assembly mounted to a stapler body and configured to be actuated by the wire, said lever assembly comprising two levers, each lever having a first side extending in a first direction transverse to a stapling direction, each lever having a second side extending in a second direction corresponding to said stapling direction, one said second side having a wire guide, and another said second side having a wire sensor opposite said wire guide;

a cutter connected to said lever assembly and moveable in a direction transverse to said stapling direction upon actuation of said lever assembly by the wire;

further comprising a wire supply unit driven by a stepper motor, wherein a wire length is determined by a predetermined number of steps of said stepper motor; and staple forming and driving elements mounted to said stapler body and moveable in said stapling direction.

* * * * *